US010378853B1

(12) United States Patent
Liu

(10) Patent No.: US 10,378,853 B1
(45) Date of Patent: Aug. 13, 2019

(54) COCKING DEVICE FOR CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung ( * ) Notice: Subject to any disclaimer, the term of this patent is extended or adjusted under 35 U.S.C. 154(b) by 0 days.

(21) Appl. No.: 16/197,378

(22) Filed: Nov. 21, 2018

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS 3,670,711 A * 6/1972 Firestone ..... F41B 5/12 124/25
3,783,852 A * 1/1974 Shepherd ..... F41B 5/12 124/22
4,649,892 A * 3/1987 Bozek ..... F41B 5/10 124/25
4,827,894 A * 5/1989 Schallberger ..... F41B 5/12 124/25
4,942,861 A * 7/1990 Bozek ..... F41B 5/12 124/25
5,215,069 A * 6/1993 Liu ..... F41B 5/12 124/25

* cited by examiner

*Primary Examiner* — John A Ricci

(57) ABSTRACT

A crossbow includes a barrel, a retention unit, a link unit and a positioning unit. When the second link pivots toward the restriction member, the rod is moved with the slot of the restriction member, and the restriction member is pivoted relative to the second link. The pivotal action of the first link drives the retention unit to move in the arrow track and toward the bow. On the contrary, when the retention unit is connected to the bow, the second link is moved to its initial position, and the rod is engaged with the serrated portion to form a stand-by status. When the second link continuously pivots to disengage the rod from the serrated portion, the second link is engaged with the handle to form a completion status. During the cocking action, the users may have multiple stages of action to cock the crossbow.

9 Claims, 12 Drawing Sheets

COCKING DEVICE FOR CROSSBOW

BACKGROUND OF THE INVENTION

1. Fields of the Invention

The present invention relates to a crossbow, and more particularly, to a cocking device for a crossbow.

2. Descriptions of Related Art

The conventional way to cock a crossbow is simply to pull the string toward the retention unit until the string is positioned, and the string stores energy which is used to shoot an arrow. However, it requires a significant force to successfully cock a crossbow with one action. Therefore, some assistance device such as a rope cocking device is developed to help the users to cock the crossbows more efficiently. If the string cannot be successfully positioned and expectedly bounces back, the user can easily be injured.

The present invention is intended to provide a cocking device that is easily operated and can cock the crossbow more efficiently.

SUMMARY OF THE INVENTION

The present invention relates to a crossbow and comprises a barrel having a handle on the first end thereof, and a bow is connected to the second end of the barrel. An arrow track is defined in the top of the barrel. A retention unit is movable along the arrow track. A link unit is connected to the underside of the barrel and includes a restriction member, a first link and a second link. The restriction member is pivotably connected between the first end of the barrel and the first end of the first link. A slot is defined through the restriction member and a serrated portion is formed in the inner top of the slot. The second end of the first link pivotably connected to the retention unit. The first end of the second link is pivotably located in a space defined in the underside of the barrel, and the second end of the second link is detachably connected to the handle. The first end of the second link has a tubular part extending from each of two sides thereof, and an elongate hole is defined through the two sides of the first end of the second link.

A positioning unit includes a rod and multiple springs, wherein the rod extends through the elongate hole and the slot. The springs each have the first end thereof connected to the tubular part, and respective second ends of the springs are respectively connected to the two ends of the rod.

When the second link pivots toward the restriction member, the rod moves within the slot, and the restriction member and the first link both pivot. The first link drives the retention unit along the arrow track and toward the bow, and the retention unit is engaged with the bow. The second link is pivoted to an initial position thereof while the rod is engaged with the serrated portion by the springs to form a temporary status. When the second link pivots to disengage the rod from the serrated portion, the second link is engaged with the handle to form a cocking completion status.

Preferably, the serrated portion of the slot includes multiple protrusions extending from the inner top of the slot, and multiple recesses are alternatively formed between the multiple protrusions. Each protrusion includes two inner faces and a distal end which is formed between the two inner faces.

Preferably, the serrated portion of the slot includes multiple protrusions extending from the inner top of the slot, and multiple recesses are alternatively formed between the multiple protrusions. The slot has a front end and a rear end. The front end of the slot is located close to the first end of the first link, and the rear end of the slot is located close to the first end of the barrel. Each protrusion includes two inner faces and a distal end which is formed between the two inner faces. Each protrusion extends inclinedly toward the front end of the slot.

Preferably, each protrusion has an axis which passes through the center of the distal end thereof and intersects the inner bottom of the slot at an angle of 90 degrees.

Preferably, each protrusion has an axis which passes through the center of the distal end thereof and intersects an inner bottom of the slot at angle other than 90 degrees.

Preferably, the rod includes a groove defined in the outer periphery of each of the two ends thereof. The respective second ends of the springs are respectively connected to the two grooves in the two ends of the rod.

Preferably, a grip has a connection end which is pivotably connected to the second end of the second link. A connection member is located in the second link and connected between the grip and the rod. When the grip is pivoted in the direction away from the handle and pulls the connection member, the connection member disengages the rod from the serrated portion of the slot of the restriction member. The second link is pivoted toward the handle and simultaneously presses the grip. The rod moves within the slot and is not engaged with the serrated portion.

Preferably, the second link includes a chamber defined in the second end thereof. One end of the grip is pivotably connected with the chamber by extending a pin extending through the grip and the second link. The connection member is connected to the connection end of the grip.

Preferably, a hole is defined through the first end of the second link. The restriction member extends through the hole and is pivotably connected to the first link. The hole communicates with the slot and the elongate hole.

The advantages of the present invention are that the cocking action can be completed easier for those users who do not have sufficient force by engaging the rod with the serrated portion of the slot of the restriction member in the middle of the cocking action. In other words, the present invention allows the users to cock the crossbow by multiple stages.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
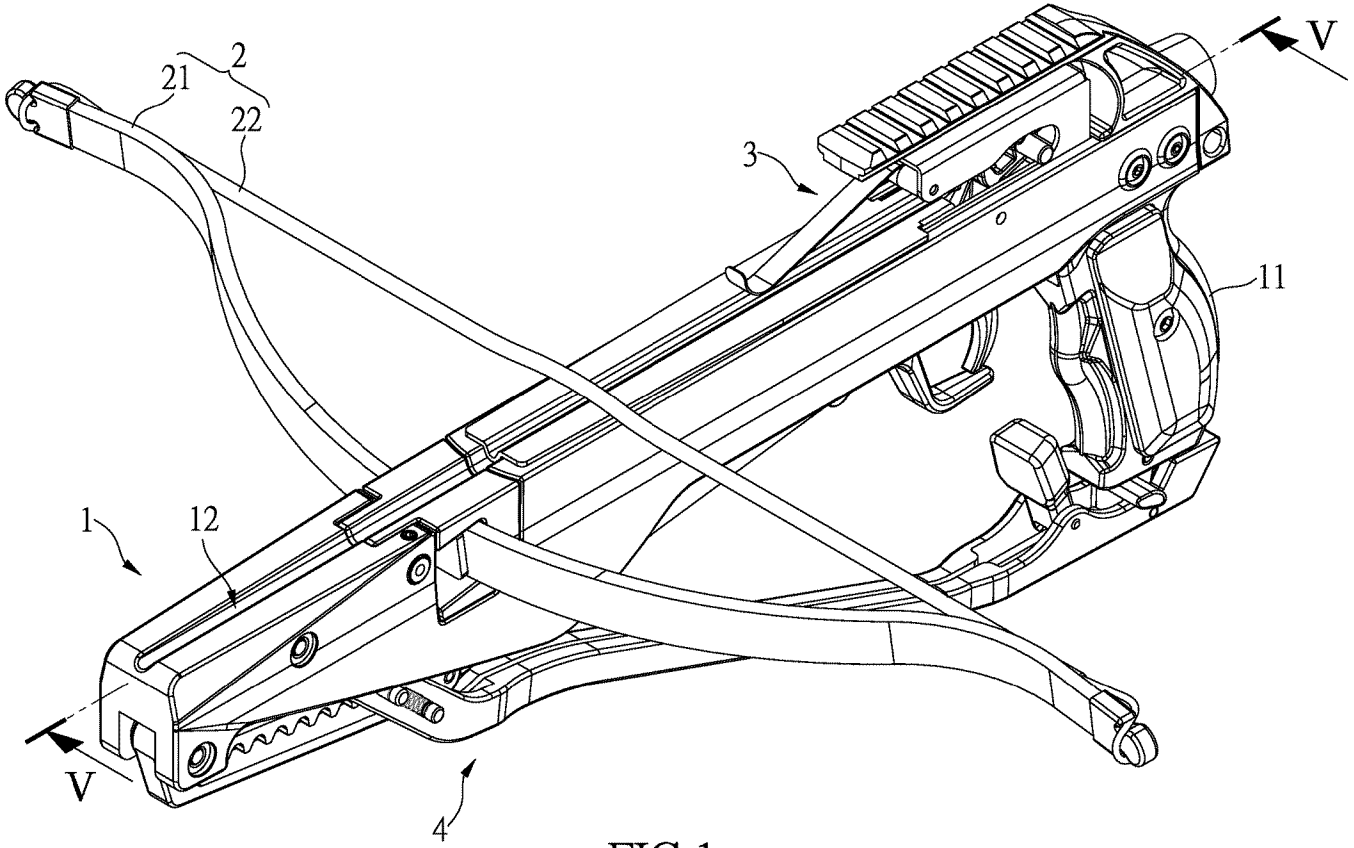
FIG. 1 is a perspective view to show the crossbow of the present invention.

Referring to FIGS. 1 to 9, the crossbow of the present invention comprises a barrel 1 having a handle 11 formed on the underside of the first end thereof, and a bow 2 is connected to the second end of the barrel 1. An arrow track 12 is defined in the top of the barrel 1. A retention unit 3 is located on the top of the barrel 1 and is movable along the arrow track 12 so as to operate the string 22 of the bow 2.

A link unit 4 is connected to the underside of the barrel 1 and includes a restriction member 41, a first link 42 and a second link 43. The restriction member 41 is pivotably connected between the first end of the barrel 1 and the first end of the first link 42, and a slot 411 is axially defined through the restriction member 41. A serrated portion 412 is formed in the inner top of the slot 411. The second end of the first link 42 is pivotably connected to the retention unit 3. The first end of the second link 43 is pivotably located in a space 13 defined in the underside of the barrel 1, and the second end of the second link 43 is detachably connected to the handle 11. The first end of the second link 43 includes a tubular part 431 extending from each of two sides thereof, and an elongate hole 432 is defined through the two sides of the first end of the second link 43. A positioning unit 5 includes a rod 51 and multiple springs 52. The rod 51 extends through the elongate hole 432 and the slot 411. The springs 52 each have a first end connected to the tubular part 431, and respective second ends of the springs 52 respectively connected to the two ends of the rod 51.

As shown in FIGS. 6 to 9, when the second link 43 pivots toward the restriction member 41, the rod 51 moves within the slot 411, and the restriction member 41 and the first link 42 both pivot. The first link 42 drives the retention unit 3 along the arrow track 12 and toward the bow 2, and the retention unit 3 is engaged with the bow 2, the second link 43 is pivoted to an initial position thereof while the rod 51 is engaged with the serrated portion 412 by the springs 52 to form a temporary status. When the second link 43 continuously pivots to disengage the rod 51 from the serrated portion 412, the second link 43 is engaged with the handle 11 to form a cocking completion status. The temporary status allows the user to take a break and does not have to pull the string 22 to the cocking completion status within one cocking action. That is to say, for the users who do not have sufficient force to complete the cocking action within one-time action, the cocking action can be easier. Because the rod 51 is engaged with one of the serrated portion 412, and the rod 51 is pulled by the springs 52, so that the temporary status ensures that the string 22 and the second link 43 do not unexpectedly bounce back to injure the users. Then the users can continuously pivot the second link 43 to disengage the rod 51 from the serrated portion 412, the second link 43 is engaged with the handle 11 to form the cocking completion status.

Figure 4:
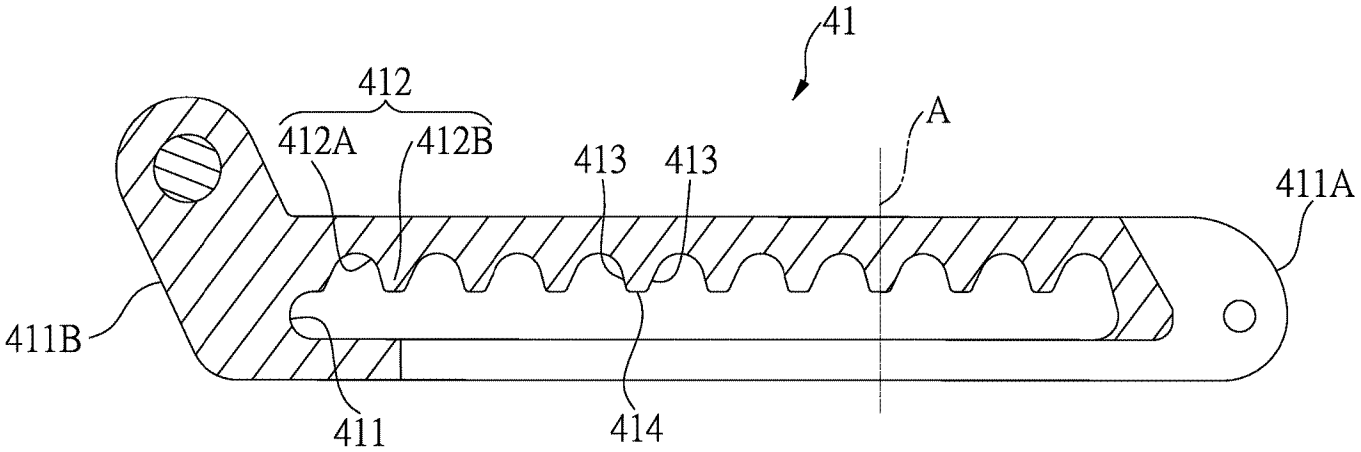
FIG. 4 is a partial cross sectional view of the restriction member of the cocking device of the crossbow of the present invention.
Figure 5:
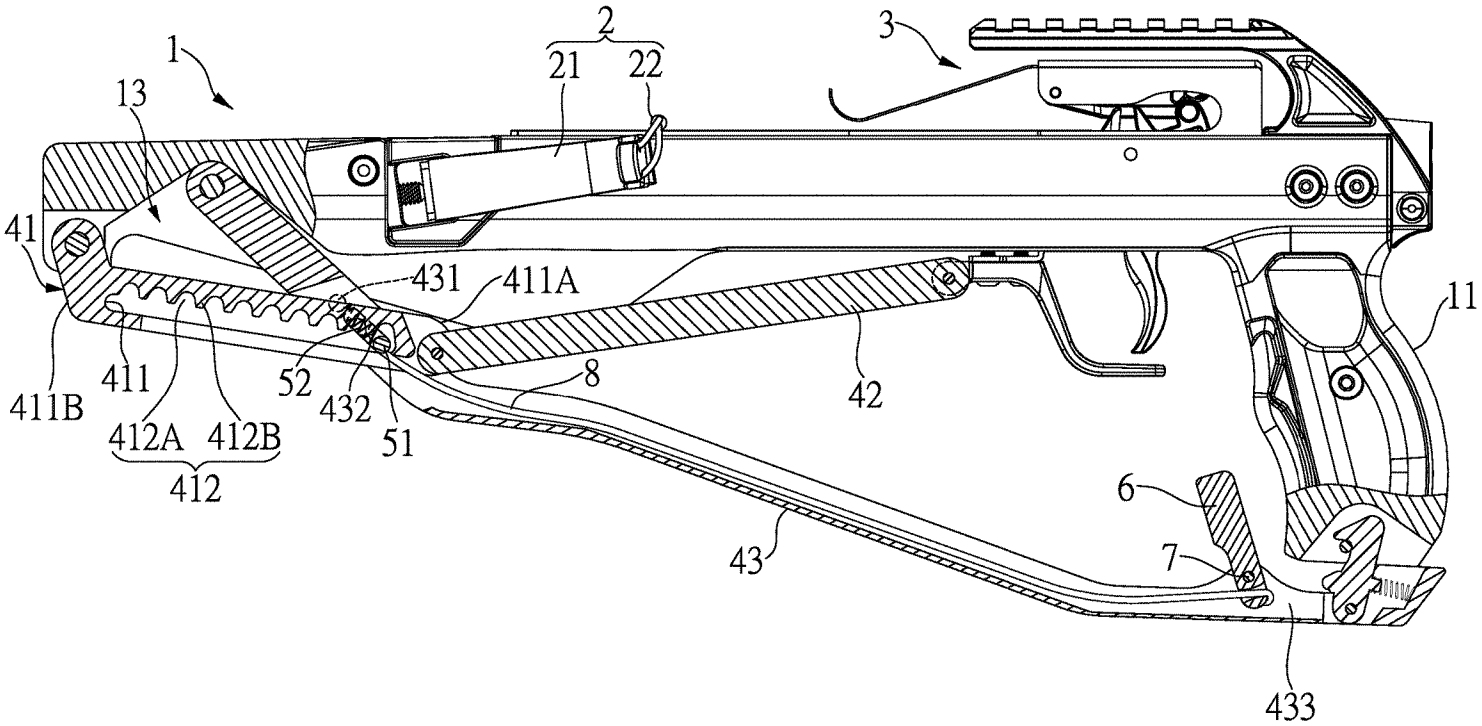
FIG. 5 is an cross sectional view, taken along line V-V of FIG. 1.
Figure 6:
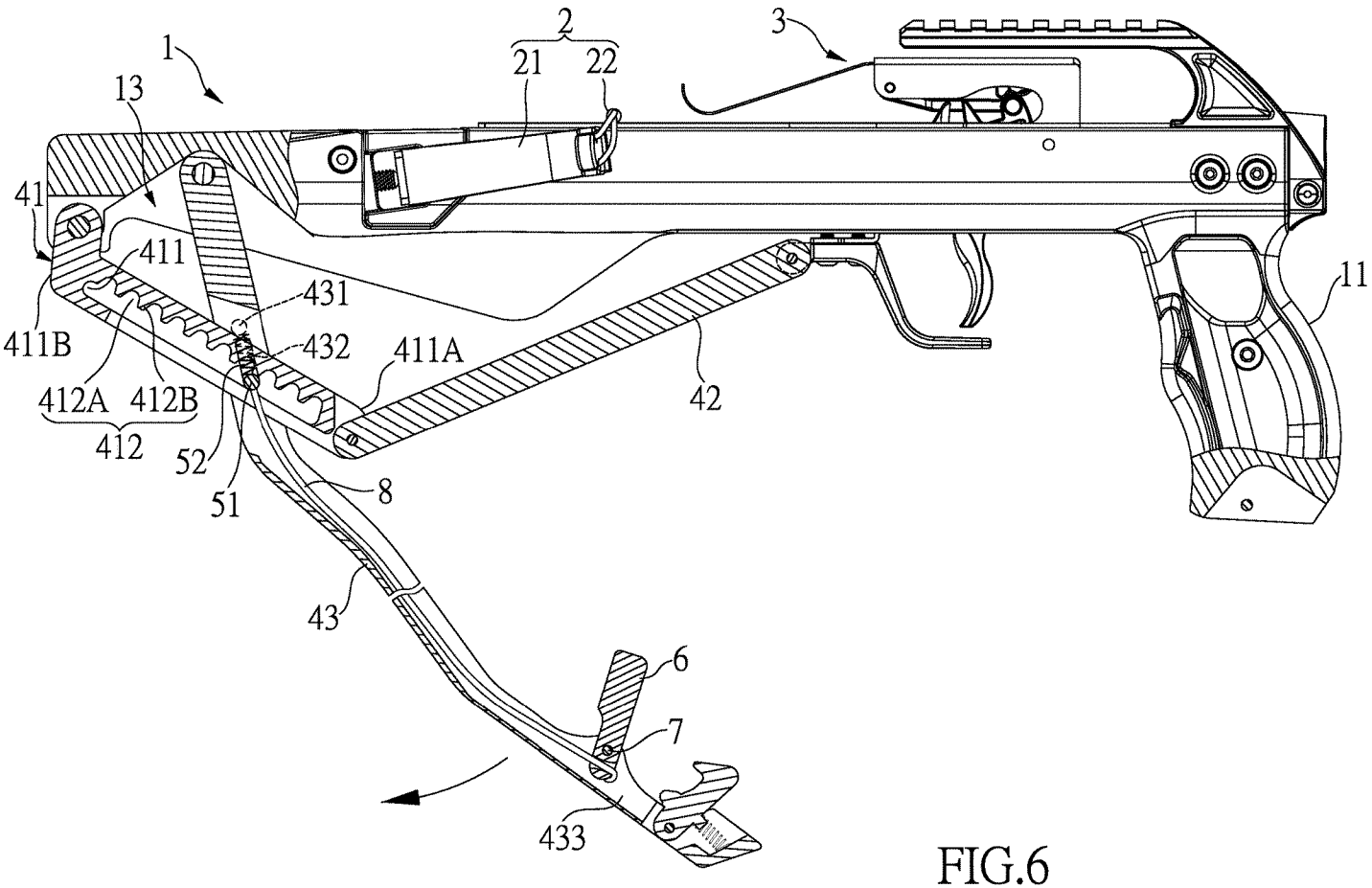
FIG. 6 shows that the second link is pivoted and the rod moves to a protrusion of the serrated portion.
Figure 7:
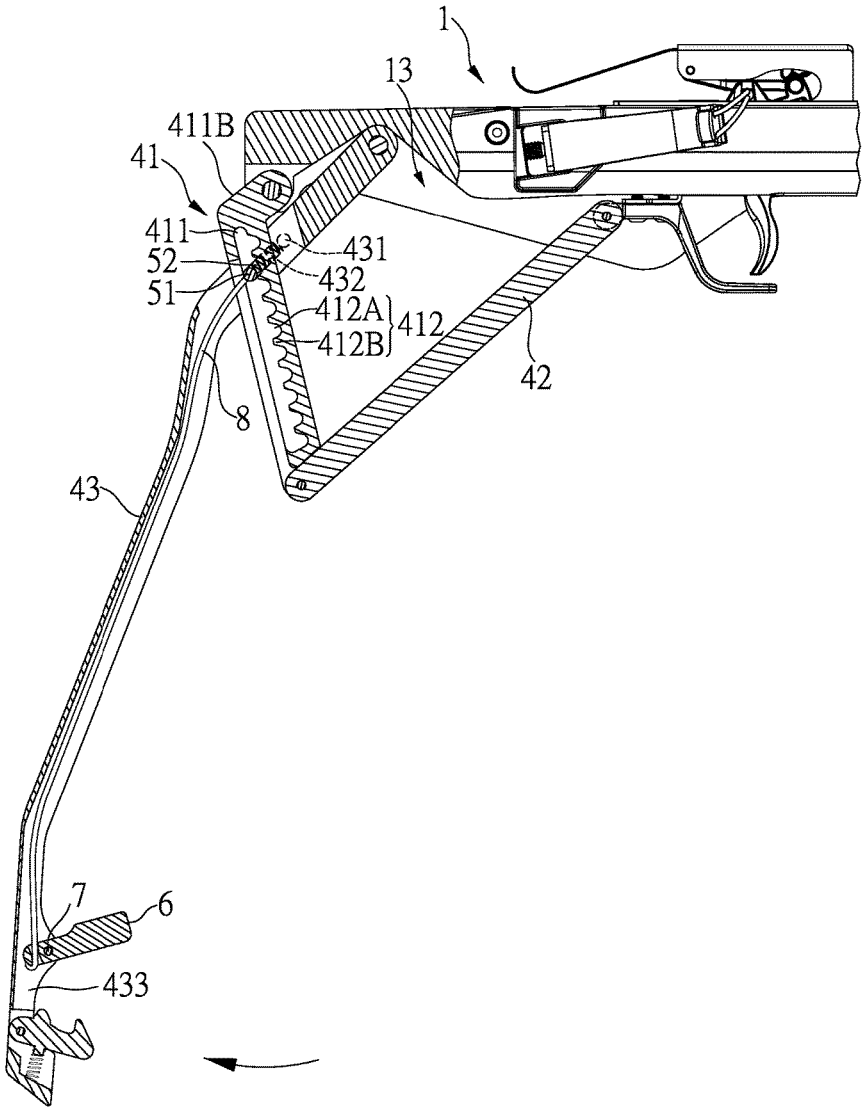
FIG. 7 shows that the rod moves toward the rear end of the slot of the restriction member.
Figure 8:
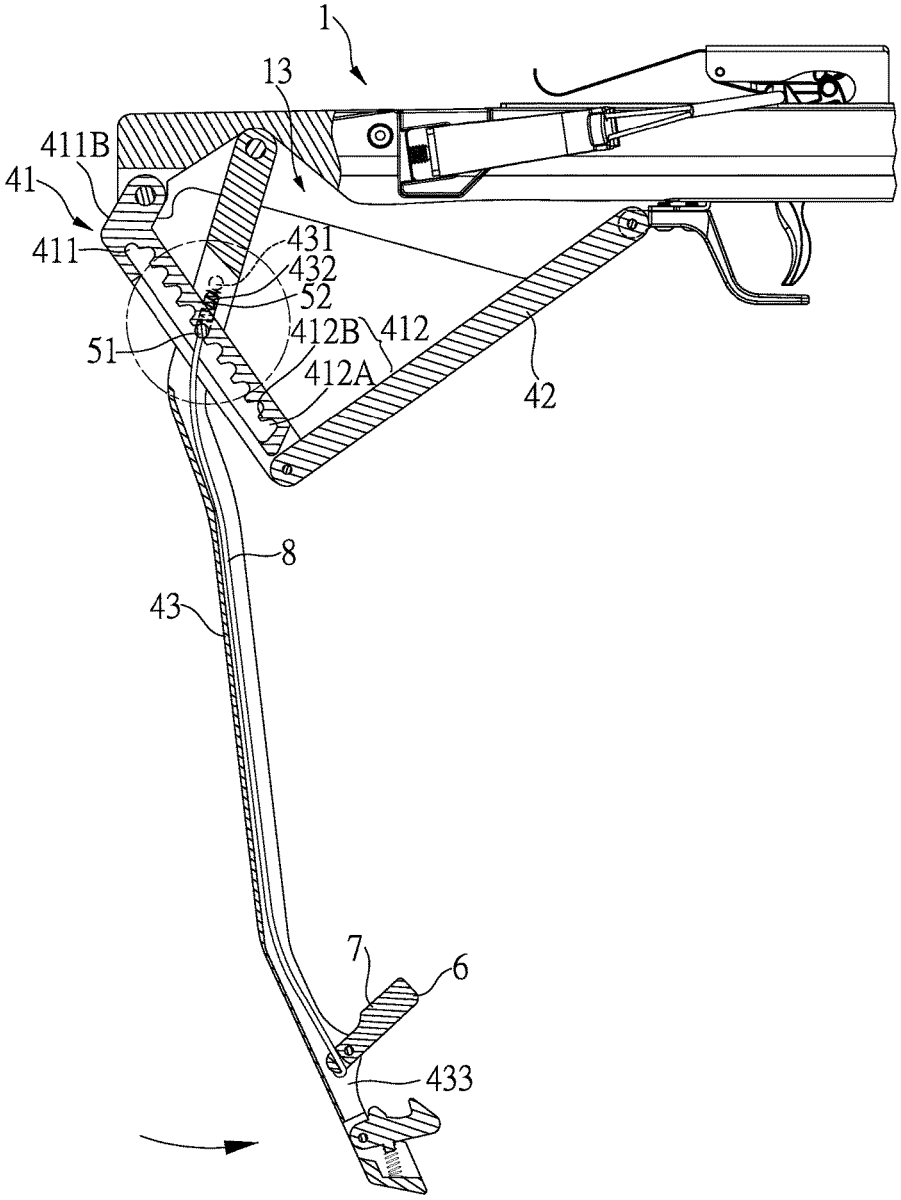
FIG. 8 shows that the second link is pivoted to its initial position.
Figure 9:
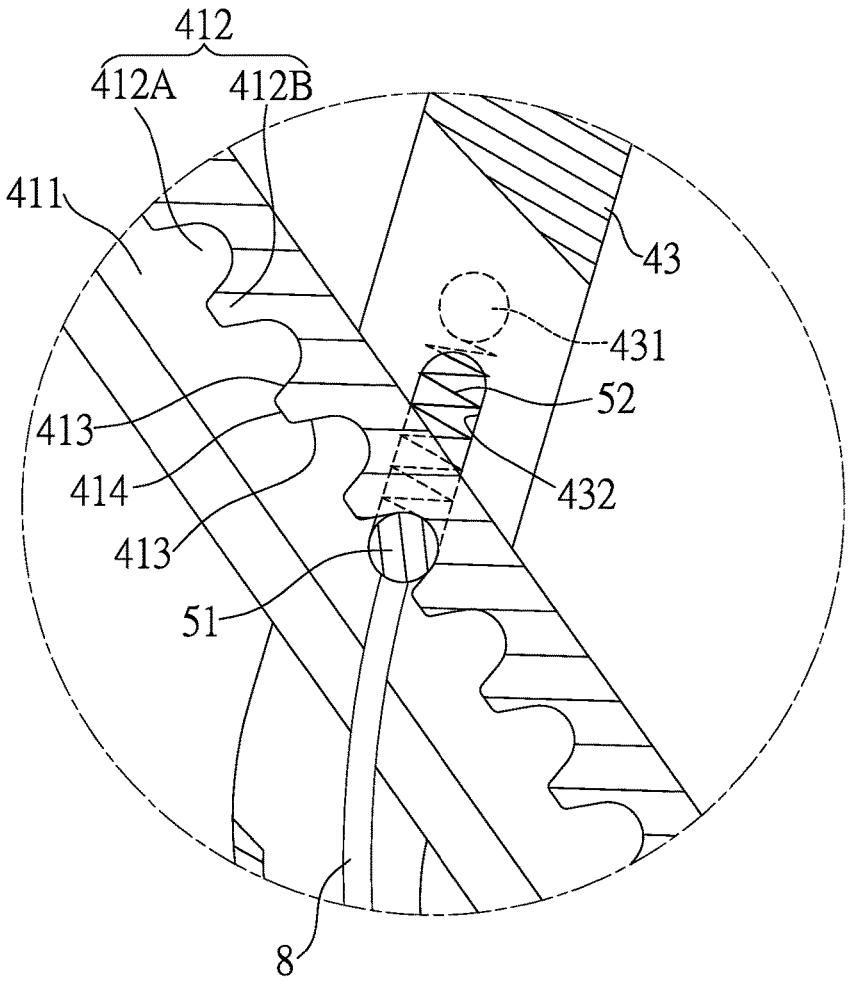
FIG. 9 is an enlarged view to show the circled portion in FIG. 8.

As shown in FIGS. 4 and 5, the serrated portion 412 of the slot 411 includes multiple protrusions 412B extending from the inner top of the slot 411. Multiple recesses 412A are alternatively formed between the multiple protrusions 412B. Each protrusion 412B includes two inner faces 413 and a distal end 414 which is formed between the two inner faces 413. The two inner faces 413 are symmetrical relative to the axis "A" of the distal end 414, wherein the axis "A" which passes through the center of the distal end 414 thereof and intersects the inner bottom of the slot 411 at an angle of 90 degrees.

Figure 10:
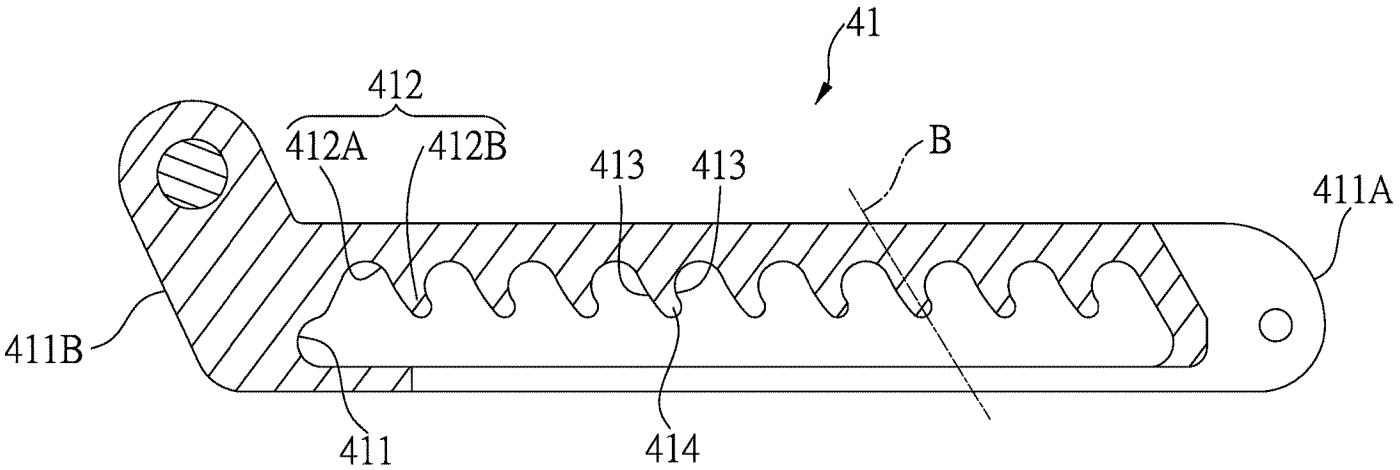
FIG. 10 shows another embodiment of the serrated portion of the restriction member.
Figure 11:
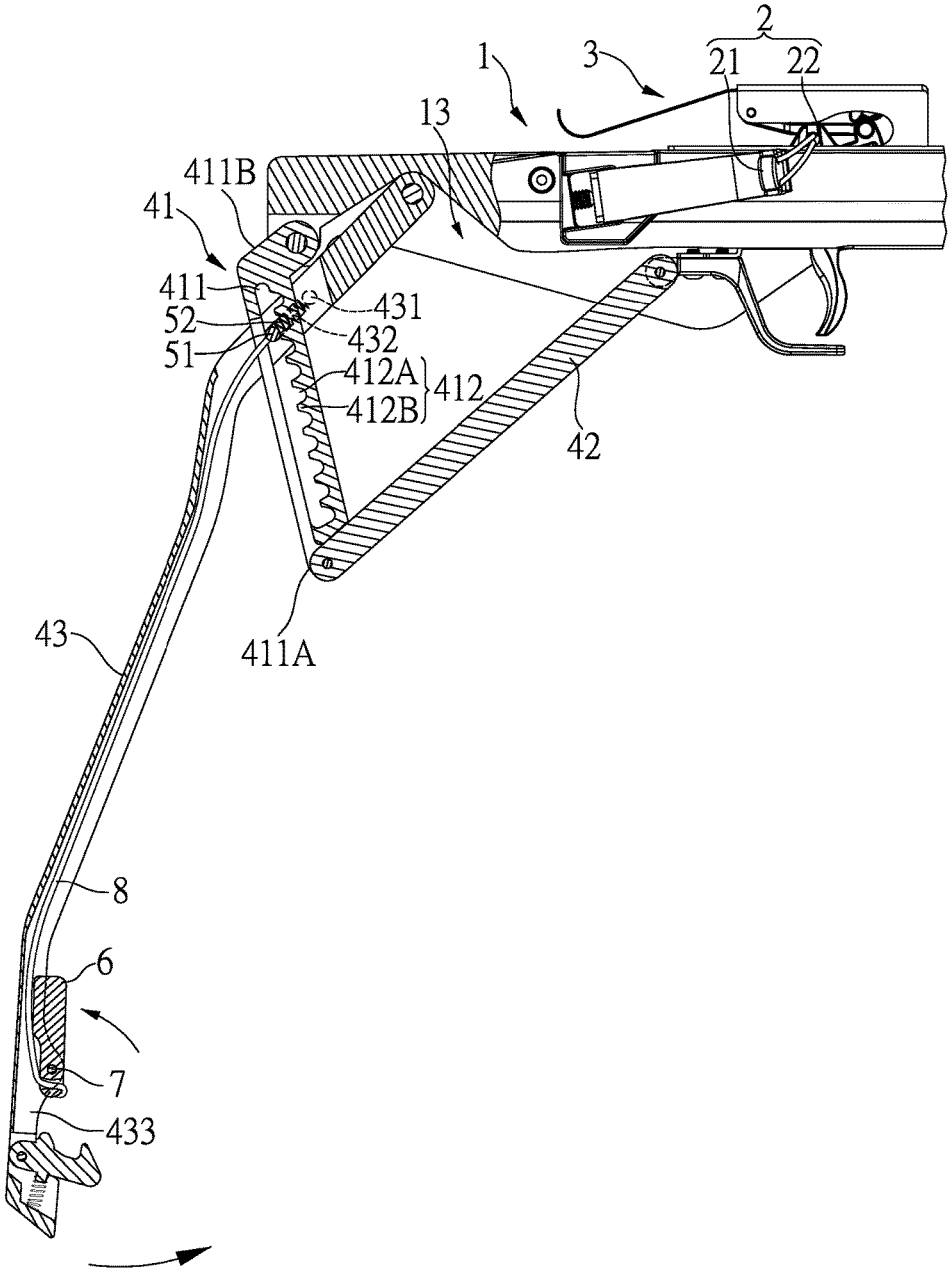
FIG. 11 shows that the grip is pressed and the connection member drives the rod to move.
Figure 12:
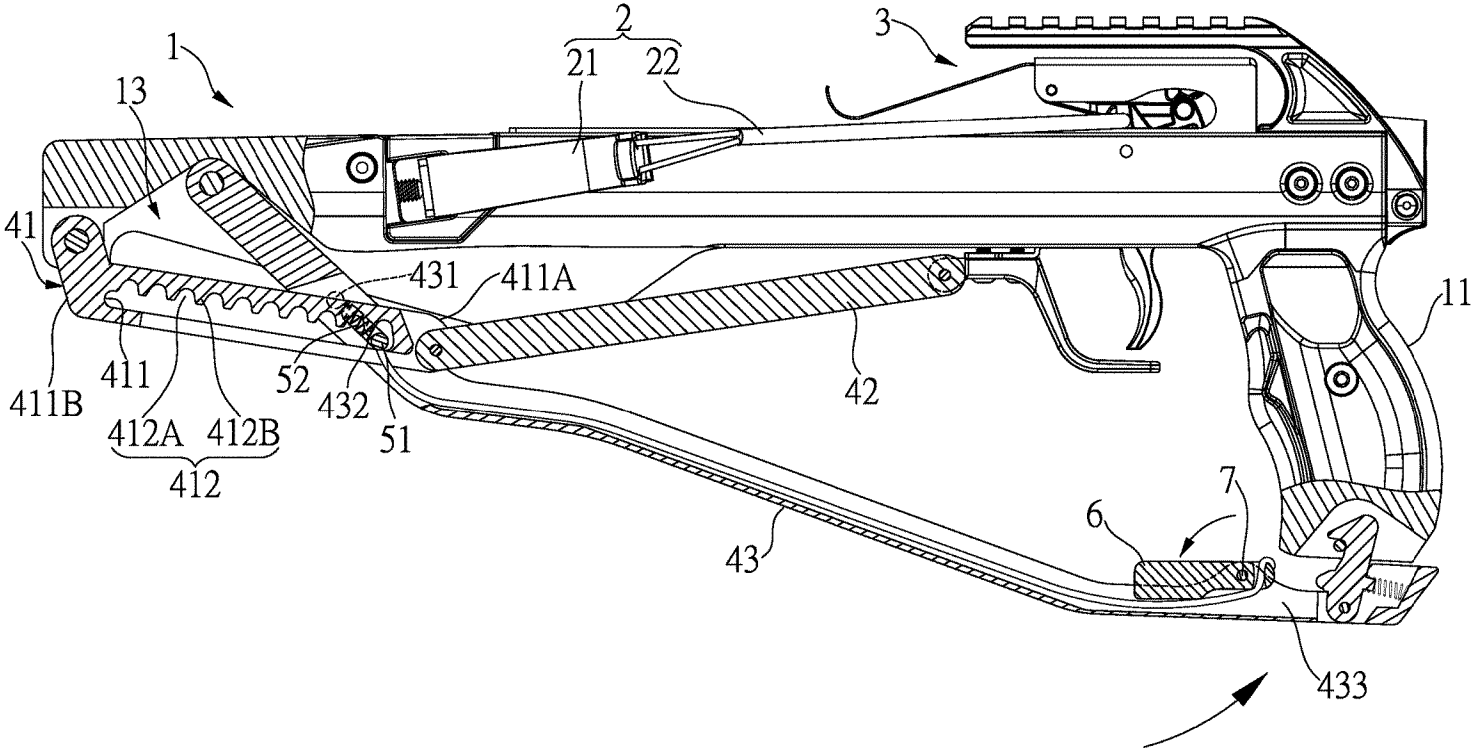
FIG. 12 shows that the second link is pivoted toward the handle.

FIG. 10 shows another embodiment of the serrated portion 412, wherein the serrated portion 412 of the slot 411 includes multiple protrusions 412B extending from the inner top of the slot 411, and multiple recesses 412A are alternatively formed between the multiple protrusions 412B. The slot 411 has a front end 411A and a rear end 411B, wherein the front end 411A of the slot 411 is located close to the first end of the first link 42, and the rear end 411B of the slot 411 is located close to the first end of the barrel 1. Each protrusion 412B includes two inner faces 413 and a distal end 414 which is formed between the two inner faces 413. The two inner faces 413 have different shapes and are not symmetrical relative to the axis "B" of the distal end 414. Each protrusion 412B extends inclinedly toward the front end 411A of the slot 411. The axis "B" passes through the center of the distal end 414 thereof and intersects the inner bottom of the slot 411 at angle other than 90 degrees. By this specific shape of the protrusions 412B, the rod 51 can be securely engaged with the inner face 413 and does not slip off.

Figure 2:
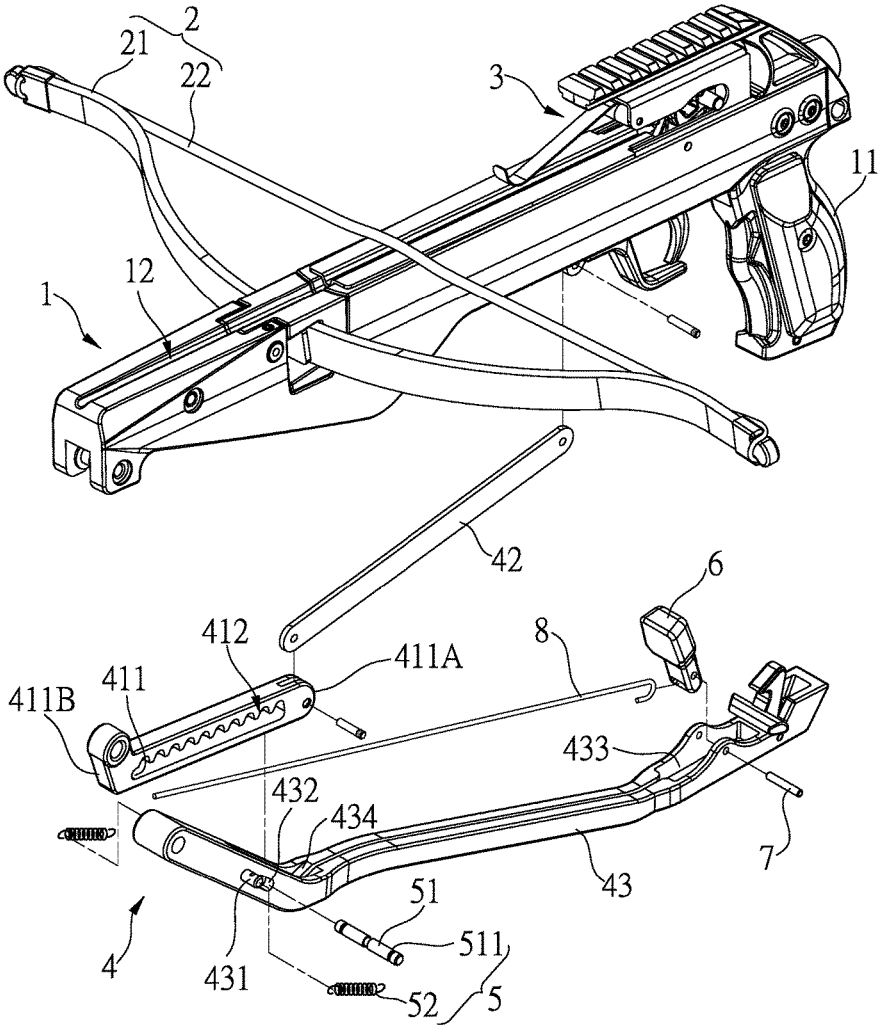
FIG. 2 is an exploded view of the cocking device of the crossbow of the present invention.
Figure 3:
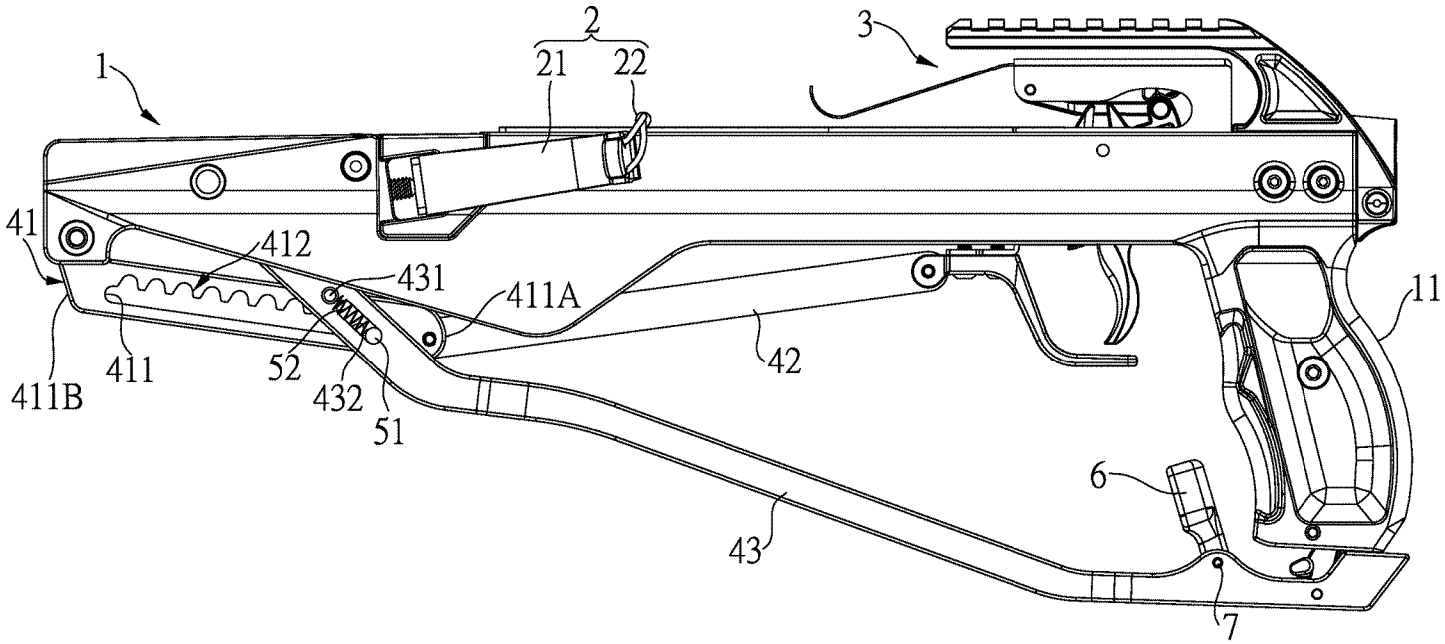
FIG. 3 is a side view of the crossbow of the present invention.

As shown in FIG. 2, the rod 51 includes a groove 511 defined in the outer periphery of each of the two ends thereof. The respective second ends of the springs 52 are respectively connected to the two grooves 511 in the two ends of the rod 51. The springs 52 provide a force to the rod 51 to position the rod 51 relative to the serrated portion 412. The second link 43 includes a chamber 433 defined in the second end thereof, and a grip 6 that has a connection end which is pivotably connected with the chamber 433 by extending a pin 7 extending through the connection end of the grip 6 and the second link 43. The connection member 8 is connected to the connection end of the grip 6. A hole 434 is defined through the first end of the second link 43. The restriction member 41 extends through the hole 434 and is pivotably connected to the first link 42. The hole 434 communicates with the slot 411 and the elongate hole 432. Besides, a connection member 8 is located in the second link 43 and connected between the grip 6 and the rod 51. When the grip 6 is pivoted in a direction away from the handle 11 and pulls the connection member 8, the connection member 8 disengages the rod 51 from the serrated portion 412 of the slot 411 of the restriction member 41. The second link 43 is pivoted toward the handle 11 and simultaneously presses the grip 6. The rod 51 moves within the slot 411 and is not engaged with the serrated portion 412. Therefore, for the users who have sufficient force, they can press the grip 6 by the thumb and simultaneously pivot the second link 43 to engage the second link 43 with the handle 11 within one-time cocking action.

While we have shown and described the embodiment in accordance with the present invention, it should be clear to those skilled in the art that further embodiments may be made without departing from the scope of the present invention.

What is claimed is:

1. A crossbow comprising:

a barrel having a handle formed on an underside of a first end thereof, a bow connected to a second end of the barrel, an arrow track defined in a top of the barrel;

a retention unit located on the top of the barrel and movable along the arrow track;

a link unit connected to the underside of the barrel and including a restriction member, a first link and a second link, the restriction member pivotably connected between the first end of the barrel and a first end of the first link, a slot defined through the restriction member, a serrated portion formed in an inner top of the slot, a second end of the first link pivotably connected to the retention unit, a first end of the second link pivotably located in a space defined in the underside of the barrel, a second end of the second link detachably connected to the handle, the first end of the second link having a tubular part extending from each of two sides thereof, an elongate hole defined through the two sides of the first end of the second link, and a positioning unit having a rod and multiple springs, the rod extending through the elongate hole and the slot, the springs each having a first end connected to the tubular part, respective second ends of the springs respectively connected to the two ends of the rod, when the second link pivots toward the restriction member, the rod moves within the slot, and the restriction member and the first link both pivot, the first link drives the retention unit along the arrow track and toward the bow, and the retention unit is engaged with the bow, the second link is pivoted to an initial position thereof while the rod is engaged with the serrated portion by the springs to form a temporary status, when the second link pivots to disengage the rod from the serrated portion, the second link is engaged with the handle to form a cocking completion status.

2. The crossbow as claimed in claim 1, wherein the serrated portion of the slot includes multiple protrusions extending from the inner top of the slot, multiple recesses are alternatively formed between the multiple protrusions, each protrusion includes two inner faces and a distal end which is formed between the two inner faces.

3. The crossbow as claimed in claim 1, wherein the serrated portion of the slot includes multiple protrusions extending from the inner top of the slot, multiple recesses are alternatively formed between the multiple protrusions, the slot has a front end and a rear end, the front end of the slot is located close to the first end of the first link, the rear end of the slot is located close to the first end of the barrel, each protrusion includes two inner faces and a distal end which is formed between the two inner faces, each protrusion extends inclinedly toward the front end of the slot.

4. The crossbow as claimed in claim 2, wherein each protrusion has an axis which passes through a center of the distal end thereof and intersects an inner bottom of the slot at an angle of 90 degrees.

5. The crossbow as claimed in claim 3, wherein each protrusion has an axis which passes through a center of the distal end thereof and intersects an inner bottom of the slot at angle other than 90 degrees.

6. The crossbow as claimed in claim 1, wherein the rod includes a groove defined in an outer periphery of each of the two ends thereof, the respective second ends of the springs are respectively connected to the two grooves in the two ends of the rod.

7. The crossbow as claimed in claim 6, wherein a grip has a connection end which is pivotably connected to the second end of the second link, a connection member is located in the second link and connected between the grip and the rod, when the grip is pivoted in a direction away from the handle and pulls the connection member, the connection member disengages the rod from the serrated portion of the slot of the restriction member, the second link is pivoted toward the handle and simultaneously presses the grip, the rod moves within the slot and is not engaged with the serrated portion.

8. The crossbow as claimed in claim 7, wherein the second link includes a chamber defined in the second end thereof, the connection end of the grip is pivotably connected with the chamber by extending a pin extending through the connection end of the grip and the second link, the connection member is connected to the connection end of the grip.

9. The crossbow as claimed in claim 8, wherein a hole is defined through the first end of the second link, the restriction member extends through the hole and is pivotably connected to the first link, the hole communicates with the slot and the elongate hole.

* * * * *